United States Patent [19]

Heimburg et al.

[11] 4,132,179

[45] Jan. 2, 1979

[54] BURNING APPARATUS

[76] Inventors: Richard W. Heimburg, 831 Ackerman Ave.; Donald M. Stewart, 104 Robert Dr., both of Syracuse, N.Y. 13210

[21] Appl. No.: 832,191

[22] Filed: Sep. 12, 1977

[51] Int. Cl.[2] ..... F23G 3/00; F23C 9/04

[52] U.S. Cl. ..... 110/211; 110/214; 110/344; 110/347

[58] Field of Search ..... 110/210–214, 110/106, 110, 344, 345, 347

[56] References Cited

U.S. PATENT DOCUMENTS

| | | | |
|---|---|---|---|
| 3,651,771 | 3/1972 | Eberle | 110/213 |
| 3,653,344 | 4/1972 | Masek et al. | 110/212 |
| 3,707,128 | 12/1972 | Lang | 110/211 |
| 3,774,555 | 11/1973 | Turner | 110/210 |
| 3,780,674 | 12/1973 | Liu | 110/212 |
| 3,808,986 | 5/1974 | Logdon | 110/210 |
| 4,075,953 | 2/1978 | Sowards | 110/347 |

*Primary Examiner*—Henry C. Yuen

*Attorney, Agent, or Firm*—Bruns & Jenney

[57] ABSTRACT

Method and apparatus for efficiently burning a wide variety of fuels without having to add auxiliary fuel to the system or provide special air handling equipment. In the main embodiment of the invention, two cylindrical burning sections are superimposed one over the other in a cross-like configuration. The lower cylinder serves as a primary burning chamber in the system while the upper cylinder serves as an afterburner. A conveyor transports raw fuel from the front of the primary chamber through an extended burning zone. The rear of the chamber remains open to the atmosphere so that air is drawn over the moving fuel bed in the burning zone in counterflow relationship therewith. An elongated duct is aligned within the primary chamber over the burning bed of fuel and is arranged to accelerate volatile gases generated in the primary chamber into the afterburner. The angular relationship between the two cylinders is adjusted so that a turbulent vortical flow is created in the afterburner.

20 Claims, 5 Drawing Figures

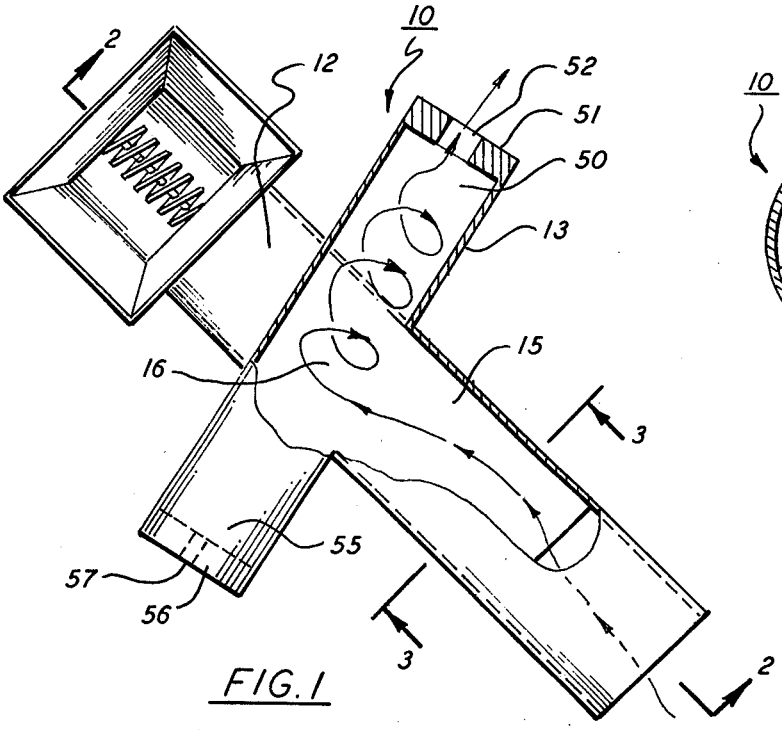
FIG. 1
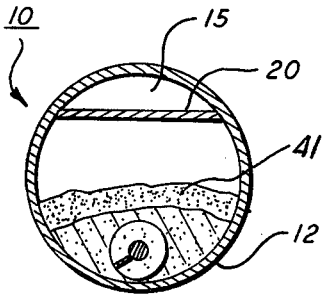
FIG. 3
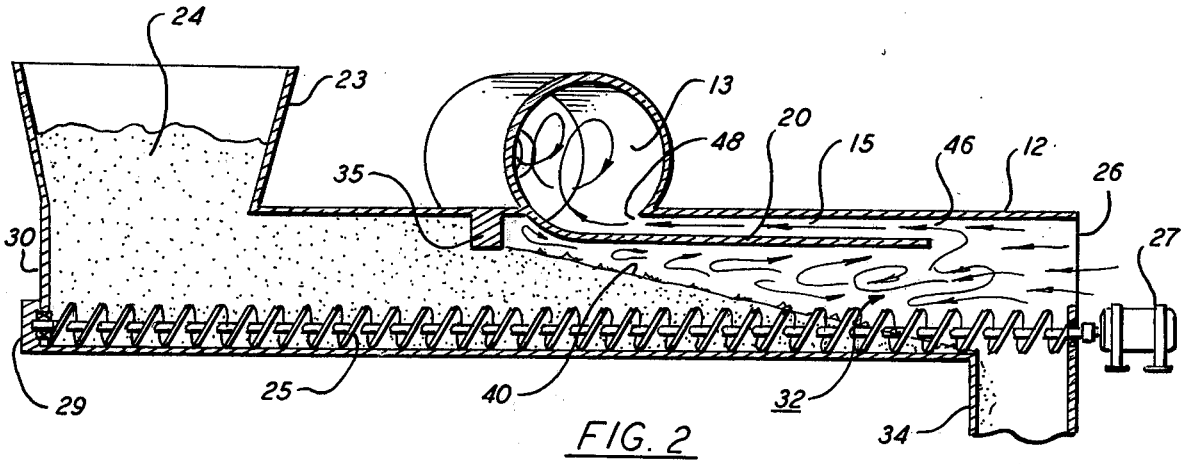
FIG. 2
FIG. 4
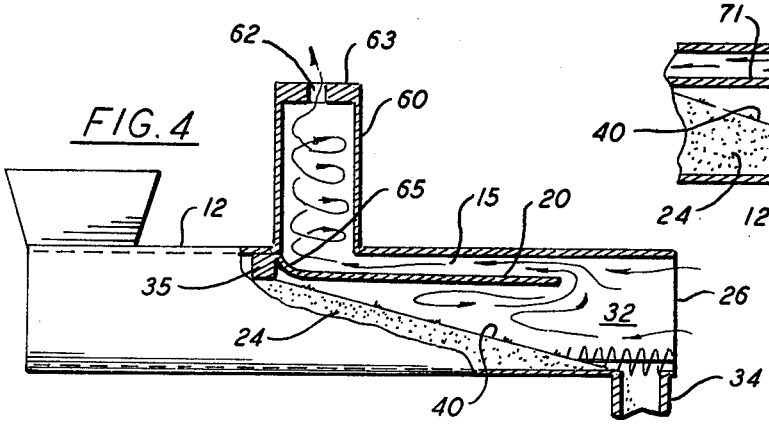
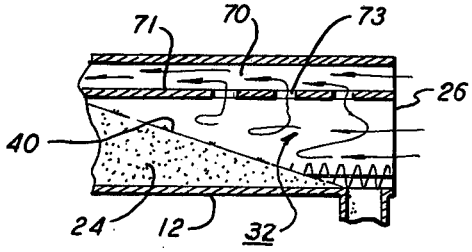
FIG. 5

BURNING APPARATUS

BACKGROUND OF THE INVENTION

This invention relates to means for efficiently burning a wide variety of fuels without the addition of auxiliary fuels or the need for special air handling equipment.

In light of the relatively strict standards presently being imposed by many government agencies, it is important to control the amount of pollution contained in stack gases when burning all types of fuels. One approach has been to place precipitators in the flue or stack of the burner and physically capture the pollution producing materials prior to their discharge into the atmosphere. This technique, however, generally involves complex and relatively expensive equipment. A less costly method of achieving clean effluents is to provide for thorough or complete combustion of the fuel in the burner before admitting exhaust gases to the stack.

Most recent devices for accomplishing complete combustion utilize a two step burning process wherein each step is carried out independently in a separate isolated chamber. Initially, in the first chamber, the raw fuel is generally burned using somewhat less than one hundred percent theoretical air in order to minimize flyash lofting. The combustible gases driven off during primary burning are collected and delivered to the second chamber where they are typically mixed with auxiliary fuel and air to insure complete burning. The mixture may also be acted upon by blowers and/or flow diverters to establish a turbulent flow to further insure that the high temperatures required for complete burning are maintained in this section.

Although the two step burning process affords many advantages over other known processes, its full potential has, heretofore, never been truly realized simply because the operation of the two sections involved have never been brought together to provide for a self-sustaining fully augmented system.

SUMMARY OF THE INVENTION

It is therefore an object of the present invention to improve the performance of two stage burners.

A further object of the present invention is to provide a burner having a primary burning stage and a secondary burning stage that are intergrated in a manner to provide clean and efficient burning of a wide variety of fuels.

Yet another object of the present invention is to achieve relatively complete burning of typically dirty fuels without the need of special equipment or the addition of auxiliary fuel to the system.

A still further object of the present invention is to provide a burner that is simple in construction and which relies upon a natural draft to produce a self-regulating high temperature combustion of a wide variety of fuels.

These and other objects of the present invention are attained by means of a burner including a primary burning chamber formed of an open ended cylinder having a conveyor operatively associated therewith for bringing a supply of fuel from the front of the cylinder through a primary burning zone in counterflow relationship with air drawn into the chamber through its open rear end. A flow accelerator and heat amplifier, in the form of an elongated duct, is positioned in the chamber over the primary burning zone. The entrance to the duct is located at the rear of the chamber in the burning zone to accept gases generated in the burning zone. The exit of the duct is arranged to discharge outside of the chamber over the point where fuel enters the burning zone. In one embodiment of the invention an afterburner is connected to the discharge of the duct to receive volatile gases discharged therefrom and turn the gas stream into a turbulent vortical flow capable of promoting extremely high temperatures whereby the gases exhausted from the afterburner are polished.

BRIEF DESCRIPTION OF THE DRAWINGS

For a better understanding of the present invention as well as other objects and further features thereof, reference is had to the following detailed description of the invention to be read in conjunction with the accompanying drawings, wherein:

FIG. 1 is a top plan view of a burner embodying the teachings of the present invention with portions broken away to more clearly illustrate the flow of gases through the burner sections;

FIG. 2 is an enlarged sectional view of the burner illustrated in FIG. 1 taken along line 2—2 in FIG. 1;

FIG. 3 is a sectional view of the burner illustrated in FIG. 1 taken along lines 3—3 in FIG. 1;

FIG. 4 is a side elevation in section showing a further embodiment of the present invention in which the afterburner stage is positioned in vertical alignment above the primary burning stage; and FIG. 5 is a partial view in section showing the rear portion of the primary burning stage and further illustrating an alternate arrangement of the flow accelerator and heat amplifier section connecting the two stages.

DESCRIPTION OF THE PREFERRED EMBODIMENT

Referring initially to FIGS. 1-3, there is shown a burner assembly, generally referenced 10, incorporating the teachings of the present invention. The burner, when compared to most two stage burners used in the art, is of simple construction that includes a primary burning chamber 12 (primary stage) and an afterburner 13 (secondary stage) that are interconnected by a combined flow accelerator and heat amplifier which, in this particular embodiment, is an elongated duct 15 of relatively constant area. In operation, the burner is adapted to carry out a two step burning process utilizing a wide variety of fuels, such as solids, liquids or slurries, without the need of using fuel metering devices, gas cleaning equipment or separate oxidants as conventionally employed in this type of installation. Raw fuel is initially burned in the primary stage with an abundance of air and the volatile gases generated in this stage are then accelerated through the duct into the afterburner. Typically, the gases contain pyrolyzing and burning materials and continue to burn from initial ignition in the primary stage until complete burnout is reached in the afterburner. The afterburner is physically positioned in reference to the primary stage to promote high temperature turbulent burning of the gases again utilizing natural draft.

Both the primary and secondary stages are fabricated of a metal shell capable of withstanding the burning temperatures involved. The two stages are herein shown as extended hollow cylinders, however, any suitable form may be employed in practice. In assembly, the afterburner stage is positioned over the primary stage to create a cross-like structure as illustrated. Complimentary openings are formed in each cylinder at the region of intersection so that when the two stages are assembled they share a common opening 16 thus placing the interior of one cylinder in communication with the other. The cylinders are welded together about the margin of the opening. The weld seals the opening and also supports the two cylindrical stages in coalignment whereby the two stages lie in parallel planes.

The duct 15 is positioned within the primary burning chamber and is arranged to accelerate the flow of volatile gases moving between stages and to amplify the heating effect in the primary chamber without promoting flyash lofting or the addition of auxiliary equipment. The flow stream is typically made up of the products of initial combustion and air. The duct is formed by joining a plate 20 along the top of the primary burning chamber wherein the plate and the arcuate inner wall of the chamber cooperate to establish an extended passageway leading from entrance 46 at the rear of the chamber to an exit 48 at the common opening between cylinders. In assembly, the duct is positioned in parallel alignment with the axis of the primary chamber.

Fuel 24 is brought into the primary burning chamber through the open front end thereof by the combined action of a supply hopper 23 and an auger 25. The inclined side walls of the hopper direct fuel into the front of the cylinder where it is picked up by the auger and moved through primary burning zone 32. The auger is supported at one end in a bearing block 29, which is carried by side wall 30 of the hopper, and is coupled to a drive motor 27 at the opposite end. The auger runs along the bottom of the chamber and is sized to provide ample space within the burning zone between itself and the lower wall 20 of the duct. The motor is located outside of the chamber well back from the burning zone to prevent it from being thermally damaged when the burner is in operation. Although a hopper and auger fuel feeding arrangement is shown herein, it should be understood that the invention is not limited to this specific structure and any suitable feeding equipment capable of moving a supply of fuel through the burning zone may be employed. The present burner is generally insensitive to the nature of the fuel being processed and a wide variety of fuels can be efficiently burned therein. Selection of the fuel handling equipment may be dictated by the nature of the in process fuel.

The above noted burning zone 32 extends generally from restrictor baffle 35 to the ash drop 34. The restrictor is located along the top surface of the chamber wall just forward of the common opening formed between the stages. The restrictor narrows the fuel entrance area to the burning zone and serves to dispense fuel evenly into this region. Under the influence of the conveyor, fuel packed into the front end of the chamber is transported at a controlled rate through the burning zone. For explanatory purposes it will be assumed that the fuel experiences ignition while passing through the restricted region, although in practice initial ignition can take place on either side of this region without adverse effects. Fuel passing through the burning zone 32 is consumed and the volume of fuel decreases proportionally. Accordingly, an inclined flame front 40 running from the restrictor 35 to the ash pit 34 is supported within the burning zone.

As noted, the rear end 26 of the primary chamber 12 is open to atmosphere and a steady stream of air for supporting combustion is permitted to move under natural draft conditions into the burning zone. The unrestricted flow of air washes over the inclined bed of fuel in a counterflow relationship therewith causing the flame front to walk up the incline toward the front of the burning zone. Gas velocities about the ash drop region are held to a minimum within this crticial region thereby discouraging flyash lofting. By the same token, the gas velocity increases as it moves toward the front of the burning region to enhance ignition and aid initial burning of raw fuel entering the region.

It should be further noted that some combustion air is also being drawn into the burning zone from the front of the chamber through the porous bed of fuel. This slight forward flow of air prevents flashbacks from occurring and suppresses the generation of unwanted fuel odors in and about the hopper region. This latter feature is highly desirous when processing solid waste material in the burner.

As best seen in FIG. 3, a pyrolysis region 41, containing burning and unburnt materials, is created directly over the bed of ignited fuel. Air, entering the chamber through the back thereof, is mixed with the materials to form a relatively unstable volatile mixture of gases capable of supporting further combustion. In order to complete the combustion process and thus promote clean effluents at the exhaust end of the burner, the gases are directed through duct 15 into the afterburner where they are polished.

The volatile gases generated in the primary chamber rise to the top of the chamber and are drawn into the entrance 46 of the duct. As illustrated in FIG. 2, the duct entrance faces the open end of the primary cylinder and is positioned to accept a further supply of combustion air. As a result, the entering gas flow continues to burn as it moves along the duct toward the exit 48. The burning gases, rapidly expanding within the constant area duct passage, are consequently accelerated into the afterburner. The afterburner is angularly offset slightly from the perpendicular in regard to the primary chamber and the entering gas stream is turned by the interior wall of the afterburner into a vortical flow. Due to the high velocities generated in the duct, the flow in the afterburner becomes a swirling, highly turbulent mass, as it moves toward the exhaust end 50 thereof.

The exhaust end 50 of the afterburner is provided with a cap 51 containing one or more openings 52 for controlling the release of gases from this stage. The dynamic pressure downstream of the end cap 51 is maintained at a pressure level that is the lowest in the system by means of a chimney or induced air fan (not shown). This, in turn, provides the motive force, through natural draft conditions, to establish the required flow of gases through the system. The opposite or supply end 55 of the afterburner is similarly provided with an end cap 56 having one or more air entrance ports 57 which are tuned to allow a metered amount of air into the second stage afterburner to enhance its operation.

By creating a turbulent flow, as described above, within the afterburner extremely high temperatures are attained and the resident time at which the gases remain at these high temperatures is considerably lengthened without the need of providing for an overly generous afterburner area.

The operation of both sections of the burner is closely coordinated and integrated by means of the duct 15 to provide a self-sustaining compact installation capable of effectively combusting to completion a wide variety of fuels. Although relatively simple in construction, the duct carries out a number of important functions relative to both stages which contributes greatly to the efficient overall performance of the burner.

The duct acts as a heat exchanger in regard to the primary stage to transfer energy from the burning high temperature gases passing therethrough back into the primary burning zone through the bottom wall 20 of the duct. By design, the flow of gases through the duct is from the rear of the primary burning zone toward the front. Consequently, the relatively cooler fuel moving into the burning zone is exposed to a higher temperature flow than the spent fuel at the rear of the chamber. The conductive heat flow into the primary chamber is thus distributed in a manner for best promoting effective ignition and burning of the raw fuel.

The geometry of the primary burning chamber is also selected so that the cavity exhibits black body characteristics. The bottom wall 20 of the duct is positioned in the cavity so that radiant energy developed within the cavity is reflected or reradiated back into the burning zone. The combined effect of the radiant and conductive heat transfer mechanisms is to amplifying the burning operation within the primary stage without having to augment the burners activities from an outside source.

In operation, the duct effectively extends the length of the afterburner without consuming space or increasing the overall size of the equipment. In effect, the duct provides a premixing zone for the products of combustion produced in the primary stage and further combustion air. Generally, the second stage burning process is commenced within the duct and is well established prior to the mixture being discharged into the afterburner. In point of fact, under certain conditions, complete burning can be accomplished in the duct and the afterburner eliminated thereby further reducing the size of the burner without sacrificing performance. Normally, however, particularly when handling relatively dirty fuels, the afterburner will be required to achieve complete burning.

The duct further functions as a nozzle to accelerate the flow discharged into the afterburner. To this end, the duct can be constructed so that it converges from the entrance 46 toward the exit 48. The combined effect of the converging passage and expanding gases is to further increase the flow velocity and thus the turbulence of the flow directed into the afterburner. This can be simply accomplished by inclining the bottom wall of the duct.

Referring now to FIG. 4, there is shown another embodiment of a burner assembly employing the teachings of the present invention. In this arrangement, the afterburner stage 60 is supported in vertical alignment upon a horizontally situated primary burning chamber 12. The primary section functions as described above and like numbers represent like components. The terminal end of the stack-like afterburner contains a cap 63 having one or more openings 62 for allowing the spend gases to be exhausted from the burner. The transition or discharge region between the afterburner and the duct is provided with a tongue 65 that slopes upwardly to direct the flow into the afterburner. The tongue cooperates with the inner wall of the afterburner to shape the incoming flow stream into a swirling vortex that is directed upwardly toward the opening 62. In this configuration, the vertically extended afterburner produces a chimney effect and can be conviently connected to a conventional stack to deliver low static pressures at the exhaust end of the system.

FIG. 5 illustrates an alternative construction of the transition duct connecting the two main stages of the burner. The duct 70, which functions in the manner described above, is extended to bring the rear opening thereof out to the end of the primary chamber 12. Combustion air is thus permitted to enter the duct directly through the rear opening 26 in the chamber. A plurality of inlet gas ports 73 are strategically located in the bottom wall 71 of the duct to meter a controlled flow of combustion gases from the primary burning zone into the duct passage.

As can be seen from the above description, the present burner processes fuel on a first in first out basis within a relatively long, narrow, burning zone. Gases generated by the primary burning operation are carried over the burning fuel bed to establish some afterburning early on in the process. The counterflow configuration encourages premixing of gases in the primary chamber and, because of the relatively low velocities involved, suppresses flyash lofting within the chamber. Burning can be accomplished in the primary stage at relatively low temperatures thereby permitting the conveyor, and other component parts, to be constructed of ordinary materials rather than high priced alloys.

It should also be clear from the present disclosure that sufficient air for supporting combustion in all sections of the burner is provided by natural draft and, as a result, stable burning conditions can be maintained when the system is experiencing relatively large fluctuations in fuel flow rates. The nature of the gases generated in the system, however, remain relatively unchanged during these periods thus assuring satisfactory ignition and burning of the volatile materials.

While this invention has been described with reference to the structure disclosed herein, it is not confined to the details set forth, and this application is intended to cover such modifications or changes as may come within the scope of the following claims.

We claim:

1. Apparatus for efficiently burning a wide variety of fuels including a primary burning chamber being open at the rear, and having means operatively associated therewith for moving a supply of fuel from the front of the chamber towards the rear through a burning zone whereby combustion air is drawn from the open rear of the chamber and caused to pass over the moving bed of burning fuel moving through the burning zone, and an elongated duct aligned from front to rear within the chamber over the burning zone having an entrance at the rear of the chamber within the burning zone for receiving gas generated within the burning zone and an exit at the front of the burning zone for discharging the gas exterior said chamber whereby said gas passes through the duct in counterflow relationship with the fuel moving through the burning zone, the exit of the duct is operably associated with an afterburner for further extending the burning region for the gases prior to their being exhausted from the system, the afterburner is a section that is positioned in relation to the exit of the duct so that the discharge gases are directed into a vortical flow by the inner wall of the section.

2. The apparatus of claim 1 further including means operatively associated with a discharge region of the duct for establishing an area of low dynamic pressure at the discharge region whereby the flow of gases through the duct is enhanced.

3. The apparatus of claim 1 wherein the area of the duct is substantially constant along its length whereby the velocity of burning gases contained within the duct is accelerated as the gases move through the duct.

4. The apparatus of claim 1 wherein the area of the duct converges from the entrance region toward the exit region whereby the velocity of the gases moving through the duct is accelerated along the length of the duct.

5. The apparatus of claim 2 wherein said means operably associated with the discharge region comprises a chimney.

6. The apparatus of claim 2 wherein said means operably associated with the discharge region comprises an induced draft fan.

7. A self-sustaining burner for efficiently combusting a wide variety of fuels including an open ended generally cylindrical first section having means associated therewith for moving a supply of fuel from the front end of the cylinder through a burning zone and combustion air is drawn through the rear end of the cylinder and moved over the burning bed of moving fuel in the burning zone in counterflow relation therewith, an elongated duct positioned within the burning zone over the moving bed of fuel, the duct having an entrance at the rear of the first section for receiving a mixture of air and combustion gases generated in the burning zone and an exit located at the front of the burning zone for discharging the mixture outside said first section, and a cylindrical afterburner second section operatively connected to the first section at the exit to said duct to receive the discharge therefrom, the axis of said second section being positioned in reference to the axis of the first section whereby the discharge stream is turned into a vortical flow by the inner wall of the afterburner and directed toward an exhaust end of said second section.

8. The burner of claim 7 wherein the axis of the second section is parallel with and angularly displaced from the axis of said first section.

9. The burner of claim 8 wherein the second section is connected to the discharge of the duct at about the midsection of said second section and having further means at the exhaust end thereof for regulating the flow with the second section.

10. The burner of claim 9 wherein the opposite end of the second section is provided with an opening for allowing combustion air to be drawn into the afterburning region.

11. The burner of claim 7 wherein said means for moving fuel through said burning zone includes a hopper positioned at the front of said first section for loading the front of the section with fuel, and a conveyor means extending the length of said first section for moving the fuel loaded into said section from the front of the cylinder to the rear whereby the volume of fuel is decreased as it moves through the burning zone.

12. The burner of claim 11 further including a flow restrictor positioned within the first section at the front of the burner zone for controlling the amount of fuel passing into the burning zone.

13. The burner of claim 7 wherein the duct is formed by joining a substantially flat plate to the upper inner wall of the first section whereby the plate forms the bottom wall of said duct.

14. The burner of claim 13 wherein the duct is of substantially uniform area along its entire length.

15. The burner of claim 13 wherein the duct converges from its entrance towards its exit.

16. The burner of claim 14 wherein the plate extends to the open rear end of said first section and contains a plurality of inlet ports located at the rear of the burning zone whereby combustion air passes directly into the rear of the duct and combustion gases are metered into the duct through said ports.

17. The method of burning a fuel to completion in order to limit the amount of pollutants that are exhausted from the burner, including the steps of moving a supply of fuel through a confined burning zone, opening the back of the burning zone to atmosphere so that combustion air flows through said opening over the bed of burning fuel moving in the opposite direction, positioning an elongated duct over the burning zone with its entrance at the rear of the burning zone and its exit at the front of the burning zone whereby a mixture of air and combustion gases generated in the burning zone pass into said duct, connecting the exit of said duct to an afterburner so that the flow passing through the duct is directed directly into the afterburner, positioning the afterburner in reference to the exit of the duct whereby a turbulent flow of discharge gases is created within the afterburner, and exhausting the afterburner to an area of low static pressure whereby the flow of gases through the burner is by means of natural draft.

18. The method of claim 17 including the further step of forming the duct so that it acts as a nozzle to accelerate the flow moving therethrough into the afterburner.

19. The method of claim 18 wherein the bottom wall of the duct is positioned in close proximity with the bed of burning fuel moving through the burning zone to create a burning cavity wherein heat generated in the gases moving through the duct is transferred back into the burning zone and heat generated in the burning zone is reradiated back into the cavity by said bottom wall.

20. The method of claim 17 including the further step of opening the afterburner to atmosphere whereby further combustion air is allowed to mix with the discharge flow.

* * * * *